United States Patent [19]

Rosenwinkel et al.

[11] Patent Number: 4,783,080

[45] Date of Patent: Nov. 8, 1988

[54] METHOD OF PLAYING A MILITARY BOARD GAME

[75] Inventors: Donald A. Rosenwinkel, Oak Park; John V. Zaruba, Chicago; Jeffrey D. Breslow, Highland Park, all of Ill.

[73] Assignee: Marvin Glass & Associates, Chicago, Ill.

[21] Appl. No.: 5,028

[22] Filed: Jan. 20, 1987

[51] Int. Cl.[4] ..... A63F 3/00; A63B 67/00

[52] U.S. Cl. ..... 273/255; 273/1 GF; 273/288

[58] Field of Search ..... 273/1 GF, 255, 243, 273/280, 288

[56] References Cited

U.S. PATENT DOCUMENTS

| | | | |
|---|---|---|---|
| 3,188,089 | 6/1965 | Odell et al. | 273/1 GF |
| 4,159,117 | 6/1979 | Kuna | 273/243 |
| 4,579,346 | 4/1986 | Giuntoli | 273/258 |

*Primary Examiner*—Richard C. Pinkham
*Assistant Examiner*—Benjamin Layno
*Attorney, Agent, or Firm*—John S. Pacocha

[57] ABSTRACT

A board game in which players, using markers representing different types of global influence, challenge individual opponents. The outcome of the challenge being effected by point values of the markers of a selected type of global influence. In one form the markers are tiles and a balance beam is provided to determine the outcome of a contest without having to numerically add the point value on the markers.

6 Claims, 2 Drawing Sheets

14
12
10
8
6
4
2
2
4
6
8
10
12
14
62
60
64
66
72
74

60
68
70
72
74

ICELAND
T2
CANADA
E8
FINLAND
M6

60
82
80

POLAND
L8
60
6
6
80
82
60
80
78

METHOD OF PLAYING A MILITARY BOARD GAME

BACKGROUND OF THE INVENTION

1. Field of the Invention

This invention relates generally to board games and more particularly to strategy type games in which players battle with individual opponents.

2. Background Art

Games in which players battle with individual opponents during a turn although there are other players involved in the game, are old in the art. An example of such a prior art game is the Parker Brothers "RISK" Game. There remains, however, a need for novel variations of such games.

SUMMARY OF THE INVENTION

The present invention is concerned with providing a board game in which players obtain markers representing different types of global influence with various point values and then challenge individual opponents with the outcome of the contest affected by the point values of one particular type of global influence. Additional markers in the nature of a "wild card" are also provided. Instructions in spaces along a path on the board direct the acquisition of additional markers both from a central supply and from opposing players. Spaces also provide instructions on the conduct of the challenge contest between opposing players.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
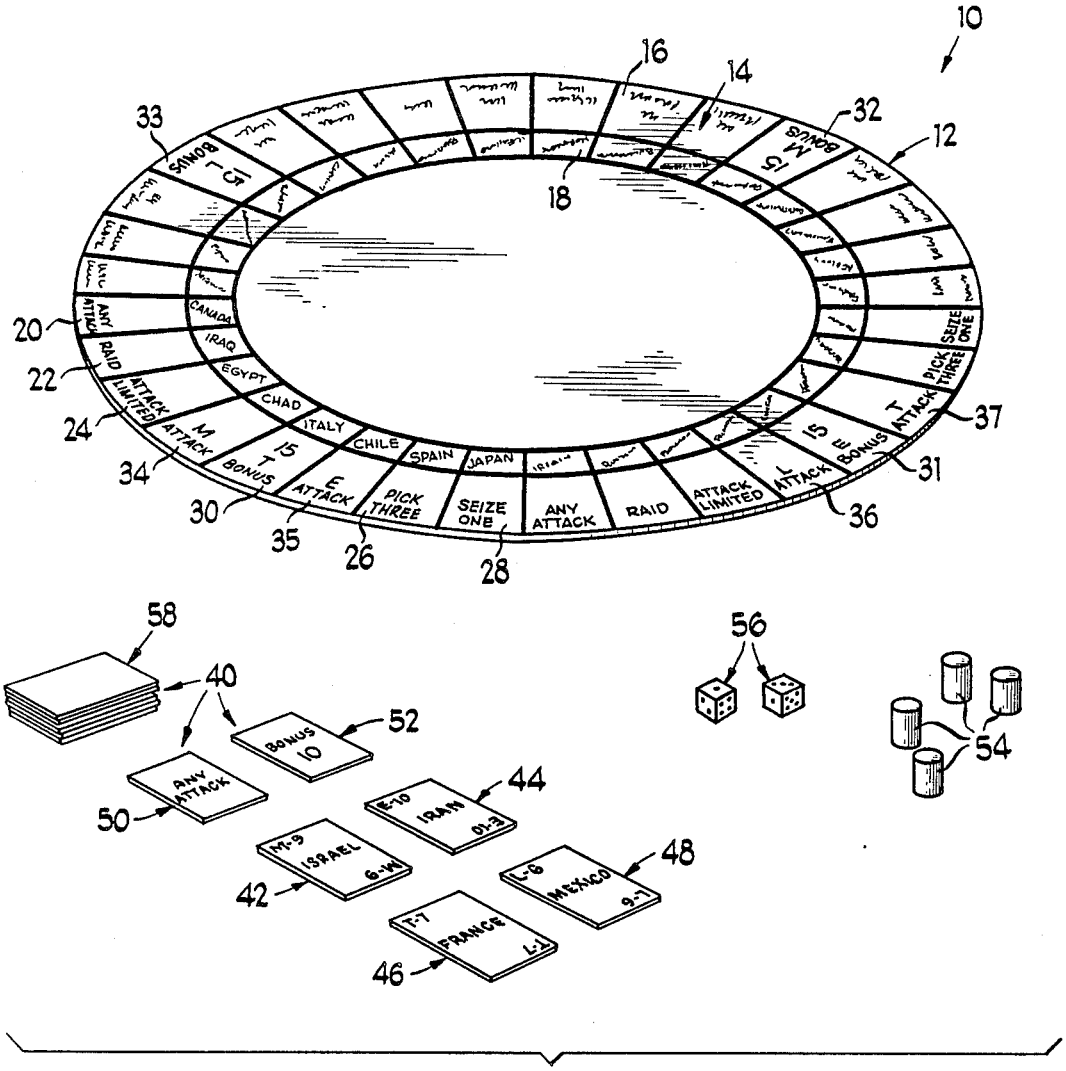
FIG. 1 is a perspective view of an embodiment of the present invention showing a game in play.

Referring now to the drawings in which like parts are designated by like reference numerals throughout the several views, a game 10 embodying the present invention is shown in FIG. 1 during the course of play. The game includes a board 12 that has a playing surface 14 with an outer path 16 and an inner concentric path 18. Both paths are divided into thirty two spaces.

In outer path 16 each of the spaces contains an instruction. Four each of "ANY ATTACK" spaces 20, "RAID" spaces 22, "ATTACK LIMITED" spaces 24, "PICK THREE" spaces 26, and "SEIZE ONE" spaces 28 are provided. There are also four "BONUS" spaces, but each provides a bonus for a different type of global influence. Thus, space 30 provides a fifteen point bonus for technology while each of spaces 31, 32, and 33 provide a fifteen point bonus for energy, military, and location, respectively. In addition, there are two each of the "M ATTACK" spaces 34, "E ATTACK" spaces 35, "L ATTACK" spaces 36 and "T ATTACK" spaces 37. Each of the thirty two spaces in inner path 18 contains the name of a different country.

Game 10 also includes a deck of cards 40 in which there are four different types of global influence cards, namely, military 42, energy 44, technology 46 and strategic location 48. Each of the global influence cards 42, 44, 46, and 48 has, in diagonally opposed corners, pips indicating the type of global influence, "M" for military, "E" for energy, "T" for technology and "L" for strategic location plus a point value from one to ten. In the center of each card there is the name of a specific country. Deck 40 also includes "ANY ATTACK" cards 50 and "BONUS" cards 52.

Each of up to four players is assigned a token 54 distinguished from other player's tokens by means of color, graphics, or three dimensional design. In an alternative embodiment, each player is assigned two similar tokens 54. Dice 56 are included for chance determination of the number of moves a player makes around paths 16 and 18.

After distribution of an equal number of, for example, six cards to each of the players, the remainder of the deck is set aside in a stack 58 providing a central supply of additional cards. Each player may initially place an assigned token 54 on the "ANY ATTACK" space in an assigned one of the four playing surface quadrants. After determining an order of play, such as by a roll of dice 56, players proceed, in turn, to move their assigned tokens along paths 16 and 18 in accordance with the roll of the dice.

Players may, at the start of each turn, obtain an additional card or marker from the central stack 58. In addition, if a player lands on a "PICK THREE" space 26, three more cards are taken from the stack. While players may possess more than the initially dealt number of cards, they may hold the number of cards initially dealt hidden in their hand. Excess cards over the initial six cards dealt must be displayed face up in front of the player. Should a player land on a "SEIZE ONE" space 28, a card is blindly taken from the hand of any selected opponent. Landing upon a "RAID" space 22 entitles a player to look at the hand of an opponent and select a card of the raiding player's choice. Should a player land on a space for which he holds the named country card, the player is given a choice to move to any other space on the board.

Following movement of the player's assigned token, the player may, if the player has landed upon an appropriate space 20, 24, 34, 35, 36, or 37, or has an "ANY ATTACK" card 50, challenge an opponent. A player using an "ANY ATTACK" card 50, may have ended movement of the token on any of the spaces. When a player launches an attack or challenge from "ANY ATTACK" space or using a card 50, the attacking player may select the type of global influence that will affect the outcome of the challenge. In other words, the attacking or challenging player may select energy, military, location or technology as the determining factor. The attacking player, using both the player's face up cards and those hidden in the player's hand, initiates the attack with one or more cards in the selected type of global influence. In response, the challenged player may, also using face up cards and those in the player's hand, put up one or more cards in the same type of global influence having a total point value greater that of the attacking player.

Once one of the players runs out of cards of the selected influence, the contest is over unless a "BONUS" card 52 may be used. If either of the players is on an appropriate "BONUS" space 30, 31, 32, or 33, those bonus points are added into the player's total at the beginning of the contest. However, in the event either of the battling players is on an "ATTACK LIMITED" space 24, then "BONUS" cards 52 may not be used and any bonus to which a player may otherwise be entitled by virtue of being on a space 30, 31, 32, or 33 is not available. When a player launches an attack from one of the spaces 34, 35, 36, or 37, the type of global influence that will be determinative of the outcome is that indicated in the space. Nevertheless, it remains the player's choice whether or not to launch the attack. At any time during an attack, either the attacker or the defender may surrender and lose all of the cards involved in the contest at that point. Otherwise, the player having the most points, including bonus points, wins the challenge and all of the markers involved. Once one player obtains all of the markers of the opponents the game is won.

In an alternative embodiment, the need to add point values of the markers is eliminated. For this purpose, tiles 60, rather than cards, are used as the markers. Tiles 60 are preferred because they have greater mass. During the course of an attack, players place their tiles on a respective side of balance beam 62. Like cards 40, tiles 60 bear the name of a country and a designation of a type of global influence along with a point value. In this alternative embodiment, the point values change in two point increments.

Figures 2, 3, 4, 5, 6:
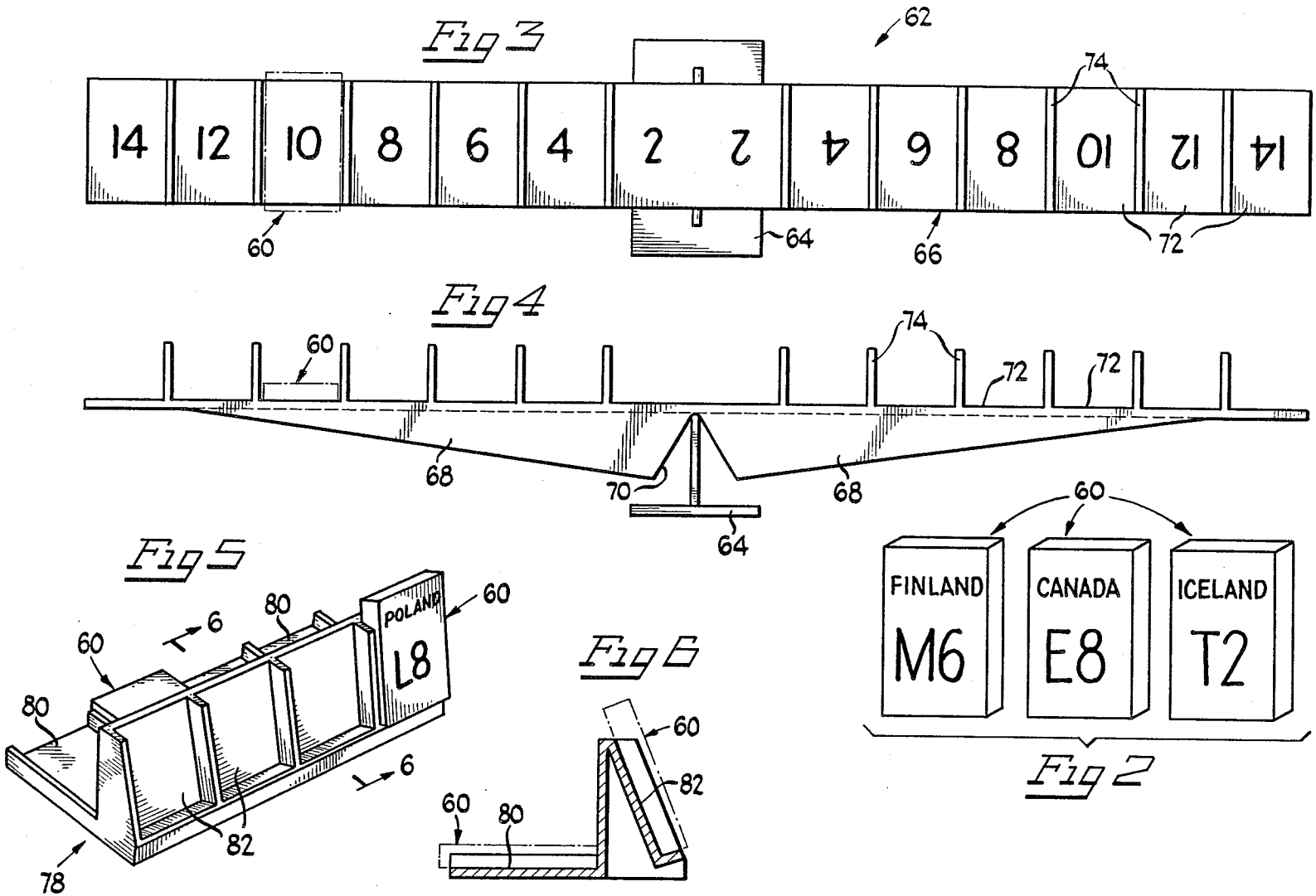
FIG. 2 is an enlarged scale, perspective view of markers used in an alternative embodiment.
FIG. 3 is an enlarged scale, top plan view of a balance beam usable with the markers.
FIG. 4 is a side elevational view of the balance beam shown in FIG. 3.
FIG. 5 is an enlarged scale, perspective view of a rack for the markers shown in FIG. 2.
FIG. 6 is a sectional view taken generally along line 6—6 of FIG. 5.

Balance beam 62 comprises a fulcrum 64 and a beam 66 having lower side walls 68 with a central V shaped notch 70 facilitating positioning of beam on fulcrum 64. On either, side of the central fulcrum position, beam 66 has tile 60 width spaces 72 divided by upstanding partitions 74. As illustrated in broken line in FIGS. 3 and 4 a tile 60 is received between the partition 74 defining a particular space 72. Each space 72 has an appropriate point value designation increasing in two point increments from the central fulcrum position to the outer most space.

When a player dedicates markers to a contest, the player places each tile in the space 72 having the appropriate point value designation. By positioning the higher point count tiles in the outermost spaces, a proportional weight is given to the point count without having to have tiles of different weight or mass. After the attacking player places the tiles on balance beam 62, the defending player may then place tiles on the defender's side of the balance beam until the contest tips in the defender's favor. The process is repeated until, as in the previous embodiment, one player no longer has any markers to use in the contest or decides to surrender.

To facilitate holding some of the tile markers hidden while displaying the excess in front of the player, a rack 78 is provided. The rack may be molded of a single piece of plastic and have a number of generally horizontal spaces 80 for the face up display of tiles 60. In addition, rack 78 has a number of slots 82 that are angled slightly away from the vertical so that tiles 60 may be positioned in spaces 82 facing, and only being visible to, one particular player.

While particular embodiments of the present invention have been shown and described, changes and modifications will occur to those skilled in the art. It is intended in the following claims to cover all such changes and modifications as fall within the true spirit and scope of the present invention.

What is claimed as new and desired to be secured by Letters Patent is:

1. A method of playing a game including the steps of:

distributing a predetermined number of markers to each player from a supply of markers representing different types with various point values;

determining by operation of a chance device how far players are to proceed along a path of instructional spaces on a board;

challenging an opponent in accordance with instructions contained in the spaces, to a contest based on the markers held by the opposing players;

the challenging player selecting one of the different types of markers; and determining the outcome of the contest as affected by the point values of the markers of the selected one type of marker.

2. The method of claim 1 including the steps of:

reserving a central supply of markers after distributing the predetermined number; and acquiring additional markers from the central supply.

3. The method of claim 1 including the step of acquiring additional markers from opposing players.

4. The method of claim 1 including the step of limiting the type of markers that may be used in a contest.

5. The method of claim 1 including the step of distributing an additional marker that may be used in place of any of the markers representing different types.

6. The method of claim 5 including the step of limiting the type of markers that may be used in a contest.

* * * * *